US005207598A

United States Patent [19]

Yamada et al.

[11] Patent Number: 5,207,598

[45] Date of Patent: May 4, 1993

[54] EDGE CARD CONNECTOR

[75] Inventors: Shoji Yamada, Machida; Yoshihisa Yamamoto, Yokohama, both of Japan

[73] Assignee: Molex Incorporated, Lisle, Ill.

[21] Appl. No.: 840,421

[22] Filed: Feb. 24, 1992

[51] Int. Cl.[5] ..... H01R 23/70

[52] U.S. Cl. ..... 439/636; 439/157; 439/862

[58] Field of Search ..... 439/630–636, 439/326–328, 152, 153, 157, 159, 160, 856, 857, 861, 862

[56] References Cited

U.S. PATENT DOCUMENTS

| | | | |
|---|---|---|---|
| 3,464,054 | 8/1969 | Mansfield | 339/176 |
| 3,486,163 | 12/1969 | De Vuyst et al. | 339/64 |
| 3,617,992 | 3/1971 | Ruehlemann et al. | 339/242 |
| 3,732,531 | 5/1973 | Bouley | 439/636 |
| 3,848,952 | 11/1974 | Tighe, Jr. | 339/91 R |
| 4,557,548 | 12/1985 | Thrush | 339/258 |
| 4,579,408 | 4/1986 | Sasaki | 439/153 |
| 4,904,212 | 2/1990 | Durbin et al. | 439/751 |
| 4,984,996 | 1/1991 | Watanabe et al. | 439/326 |
| 5,013,264 | 5/1991 | Tondreault | 439/636 |
| 5,074,800 | 12/1991 | Sacao et al. | 439/157 |
| 5,080,602 | 1/1992 | Chao | 439/326 |

FOREIGN PATENT DOCUMENTS 3208276 11/1990 Japan .

*Primary Examiner*—David L. Pirlot
*Attorney, Agent, or Firm*—Charles S. Cohen

[57] ABSTRACT

A connector for an edge card has a plurality of contact terminals spaced apart in an elongated connector housing. Each terminal has a general U-shape contact portion which extends transverse through a contact cavity slot. The contact portion is horizontally cantilevered from a vertical cantilevered positioning portion which is disposed within a recess associated with the contact cavity, and is further displaceable therein in response to insertion of an edge card into the connector card slot. The insertion of the edge card into the card slot causes the terminal to partially deflect within the recess to bring an opposing contact surface into reliable contact with the edge card.

26 Claims, 4 Drawing Sheets

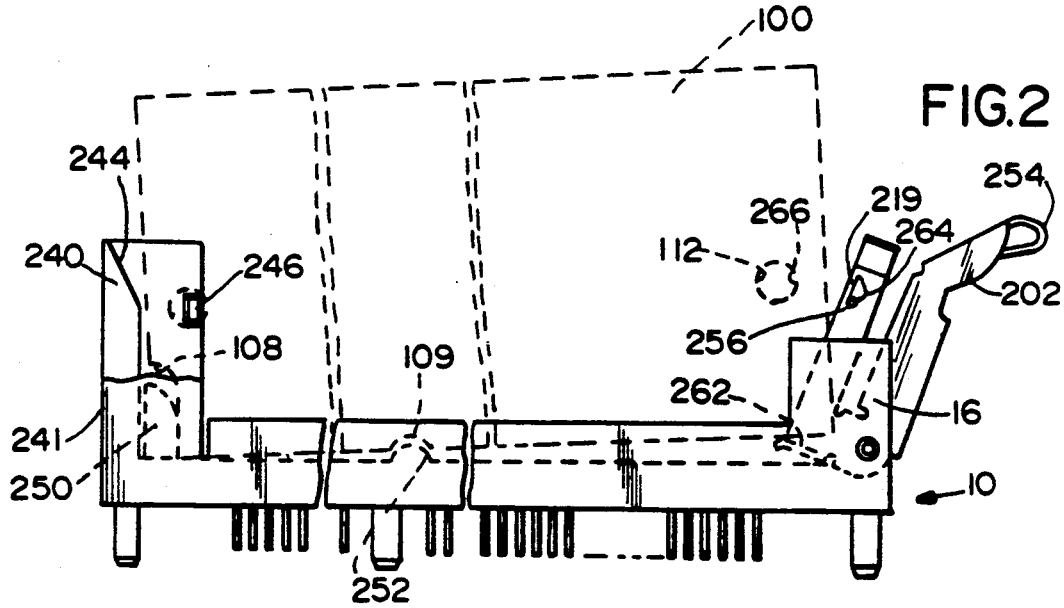
FIG.2
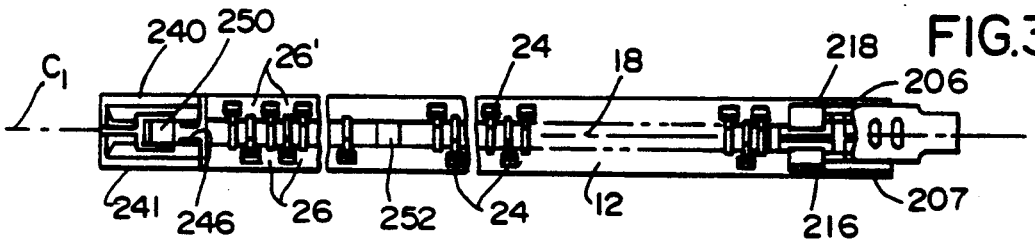
FIG.3
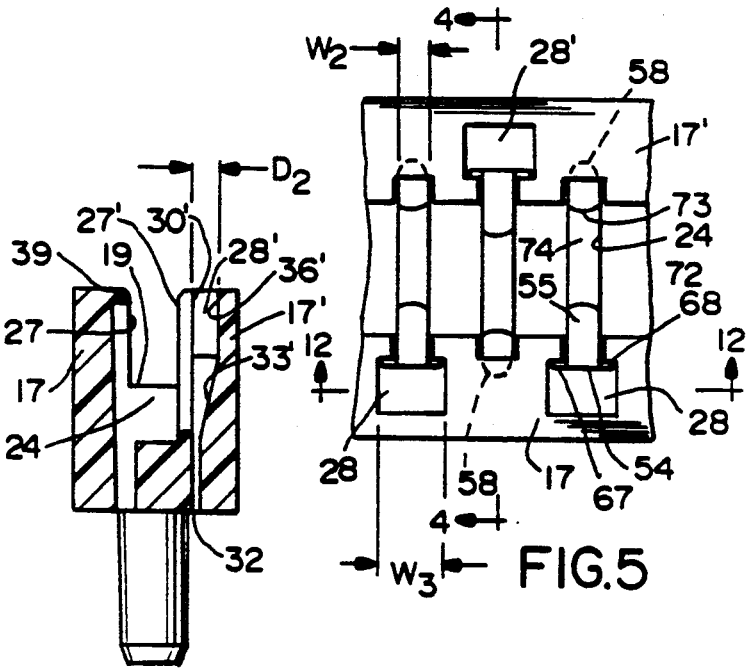
FIG.4
FIG.5

EDGE CARD CONNECTOR

BACKGROUND OF THE INVENTION

The present invention relates generally to edge card connectors, and more particularly to an edge card connector which has a plurality of generally U-shaped contacts which increase the performance of the connector.

Many electrical circuits, especially those used in the computer arts, are presently formed on one or more surfaces or levels of circuit boards, or similar substrates, to form separate circuits which may be added to computers or other electronic devices after initial manufacture thereof to improve the performance thereof. Whether such circuits are added during the initial manufacture or afterwards, these separate circuit boards must be reliably connected to the main computer printed circuit board, commonly referred to in the art as a "mother" board. The separate printed circuit boards are commonly referred to as "daughter" boards.

Connectors have been developed in the computer art which are designed for permanent installation on the mother board. These connectors contain a means for receiving the daughter board, such as a slot, to provide a connection between the mother board circuitry and the daughter board additional circuitry. These daughter boards are also descriptively referred to as "edge cards" because one side, or edge, of the card contains a plurality of relatively wide contact portions known as contact pads. The edge of the circuit card typically contains a plurality of these contact pads disposed thereon which extend laterally along one edge. One or both of sides of the edge card may contain such contact pads. This edge containing the contact pads is inserted into a slot of the connector which typically includes a number of electrical contact portions which may be similarly disposed along one or more sides of the connector slot in a manner to oppose the edge card contact pads. The connector contacts may typically include a tail portion, which projects from the connector for interconnection to the circuitry of the mother board positioned beneath or adjacent the connector. These ends are connected to the mother board by suitable means such as soldering to form an electrically conductive connection between the mother board and the edge card connector. Each connector contact further includes an edge card contact portion which is arranged within the card slot in a manner to abuttingly contact the edge card contact pads to provide an electrical connection between the edge card and the mother board.

Edge card connectors are well known in the art. One type of edge card connector is known as a low or zero-insertion force connector which is particularly suitable for receiving a single in-line computer memory module, commonly referred to as a "SIMM" module, to increase the memory capability of a computer. Such connectors are described in U.S. Pat. Nos. 3,848,952, issued Nov. 19, 1974 and 4,575,172 issued Mar. 11, 1986. In many of these low or zero insertion force edge card connectors, the connector contact terminals include two spaced-apart contact prongs, or arms, having opposing, spaced apart contact end portions. The edge card is inserted into the opening between the contact arms, contact pad edge first, and rotated for a predetermined angle until the edge card engages one or more mechanical latches. The spacing between the opposing contact arms is such that the contact pads of the edge card do not contact the contact arms of the connector with any appreciable normal force during insertion of the edge card.

Although reliable, this type of zero or low-insertion force edge card connector suffers from certain inherent disadvantages. Because such connectors require the edge card to be rotated, the spacing between adjacent connectors and other circuit board components must be sufficient to provide clearance for the insertion and rotation of the edge card. In instances where the rotatable edge cards are positioned adjacent each other, it may become necessary to remove one or more edge cards to remove a particular edge card. Finally, rotatable edge cards tend to warp because the contacts located adjacent the bottom edge of the card inherently exert a force tending to rotate the edge card back to its original position and latch mechanisms located at opposing ends of the card hold the card in an operative position. Over time and through cycles of insertion and removal, these forces tend to cause the card to warp which then causes a strain to be placed upon device I.C. leads which may cause failure thereof.

The other type of edge card connector known is commonly referred to as a "push-pull" edge card connector in which the edge card is inserted into the connector by pushing the edge card contact edge into the connector slot in a vertical direction. Removal of the edge card is attained by pulling it out of the slot or through the use of some type of urging mechanism. Such a "push-pull" type connector is described in U.S. Pat. No. 4,973,270 which issued Nov. 27, 1990. In such connectors, a plurality of contacts, or terminals, extend within the connector slot to provide the required contact surfaces for engagement when the edge card is inserted. However, certain parameters must be met in the construction of such connectors. For example, due to the translational insertion and removal nature of these connectors, it is desirable to keep the insertion forces low for ease of insertion and to minimize the wear on the edge card contact pads and the connector terminals.

Accordingly, a need exists for an edge card connector having stamped and formed resilient metal contact terminals disposed within a connector housing whereby a portion of the terminals are deflectable within the housing upon insertion of a circuit card into the connector.

SUMMARY OF THE INVENTION

The present invention is therefore directed to an edge card connector which offers significant advantages over the connectors described above, and which is reliable and which compensates for irregularities which may occur in the manufacture of edge cards. Such an edge card connector has a reduced width which permits closer spacing of secondary printed circuit cards on a primary printed circuit board.

In one principal aspect the present invention accomplishes these advantages by providing an edge card connector of the "push-pull" type having an elongated connector body with a longitudinal edge card receiving slot extending therein. The connector body has a plurality of contact-receiving cavities which intersect with and open into the connector body edge card slot. Each of the contact-receiving cavities contain an individual spring contact terminal having a generally U-shaped configuration. Each contact terminal has three distinct portions: a tail portion, a positioning portion which positions the spring contact into the card slot a predetermined distance, and a contact portion which includes two opposing contact surfaces, the first contact surface being disposed thereon above the second contact surface. The spring contacts are arranged in the connector body contact-receiving cavities in an alternating manner such that the first contact surfaces of alternating contacts extend into the card slot from different sides of the connector body, and therefore tend to urge the edge card toward the center of the card slot.

In another principal aspect of the present invention, the spring terminal is stamped and formed from a thin metal sheet to provide a general U-shaped contact portion. The solder tail portion is rigidly held within a recess adjoining the contact cavity such that the positioning portion integrally attached thereto has a vertical cantilevered character, and the contact portion thereof extends away from the positioning portion into the card slot. The U-shape of the contact portion not only enhances the spring capability of the contact, but also presents two opposing contact surfaces for the circuit card to contact when inserted into the card slot. The two contact surfaces are maintained at different relative elevations within the card slot such that the first contact surface protrudes into the card slot above the other contact surface. Therefore, when the printed circuit card is inserted into the card slot, one side of the circuit board contacts the first contact surface and deflects it partially into the contact-receiving cavity recess, thereby bringing the second contact surface into contact with an opposite side of the circuit card. In such an arrangement it has been found that the insertion force of the circuit board is minimized, therefore leading to easier insertion of circuit cards into such connectors and to reduce contact wear. The contact surfaces are also coined to enhance the reliability of the contacts with the circuit card.

In still another aspect of the present invention, the first and second contact surfaces of the terminal extend partially into the card slot. The first contact surface is aligned on the contact terminal above the second contact surface within the card slot and therefore the first contact surface deflects partially out of the card slot when the circuit board contacts it. This deflection brings the second contact surface further into the card slot and into engagement with the circuit board. The contact terminals are disposed in the card slot in an alternating fashion to thereby provide a means for centering the circuit board within the card slot.

These and other objects and advantages of the present invention will be clearly understood through a consideration of the following detailed description.

BRIEF DESCRIPTION OF THE DRAWINGS

In the course of this description, reference will be made to the attached drawings in which:

FIG. 2 is an elevational view of the edge card connector of FIG. 1 showing an edge card in phantom partially inserted into the card slot;

FIG. 3 is a plan view of the edge card connector of FIG. 1;

FIG. 4 is a cross-sectional view of the connector of FIG. 5, taken along lines 4—4, but with the contact terminals removed from the contact-receiving cavities;

FIG. 5 is an enlarged plan view of a portion of the connector housing of FIG. 1 showing the contact terminals in place within their cavities;

DETAILED DESCRIPTION OF THE INVENTION

Figure 1:
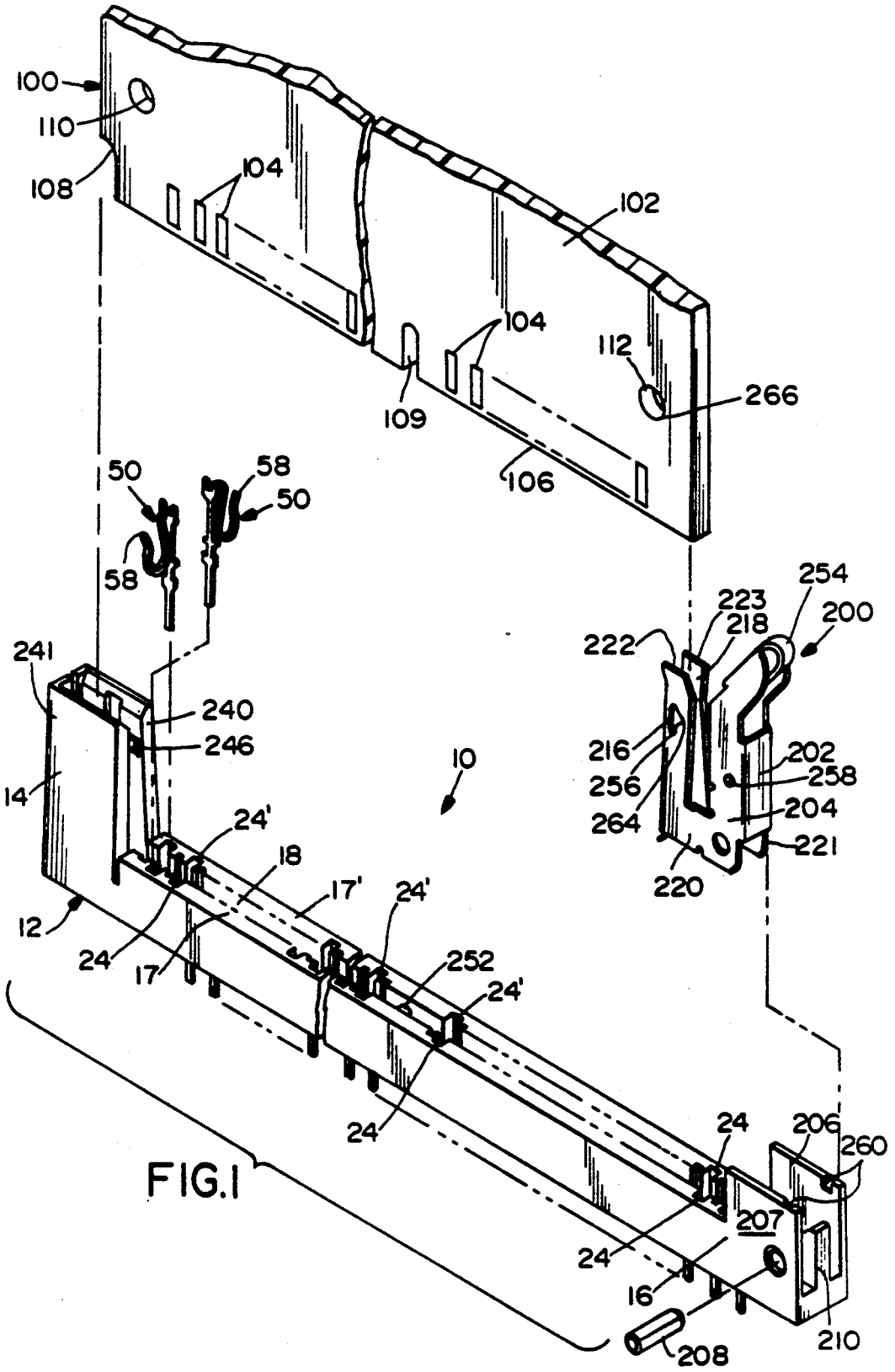
FIG. 1 is an exploded perspective view of an improved edge card connector constructed in accordance with the principles of the present invention.

FIG. 1 illustrates an exploded edge card connector, generally indicated at 10, constructed in accordance with the principles of the present invention which includes terminals, indicated generally at 50, and a latching/eject lever, indicated generally at 200, shown with a mating edge card, indicated generally at 100. As shown, the edge card 100 is received within card slot 18 of the connector 10. The edge card 100 may be conventional in nature, having a substrate 102 and a plurality of electrical contact pads 104 aligned along a marginal edge 106 of the edge card 100 and connected to electrical traces (not shown) on or in the card 100. The edge card has contact pads 104 on both sides thereof that are electrically connected to one another to provide redundant contact surfaces which improves the reliability of the edge card/electrical connector interconnection. Edge 106 is designated for insertion into the card slot 18 of the connector 10, as described below. The edge card 100 may further include a means for polarizing the card 100 properly within the connector 10 in the form of a polarizing notch 108 which interacts with projection 250 to prevent a card 100 from being rotated 180° and inserted into the card slot 18. The card 100 may further include one or more openings 110, 112 which are designed to receive, engagement means such as protruding bosses, when the edge card 100 is inserted into place within the card slot 18. The edge card 100 may also include a slot 109 that interacts with a like configured projection 252 in card slot 18 to center the edge card 100 longitudinally so that the contact pads 104 thereof are aligned with their respective contact terminals 50. The edge card 100 may have mounted thereon a plurality of electronic components such as integrated circuits, or memory modules (not shown).

As shown in FIG. 1, the connector 10 includes an elongated connector body, or housing portion, indicated generally at 12, which extends between two opposing end portions 14 and 16. The connector 10 includes an elongated slot, or channel, 18 which extends longitudinally between the opposing end portions 14, 6. The channel 18 is generally defined by two spaced-apart connector housing sidewalls 17, 17' and a connector housing floor 19. (FIG. 3) The sidewalls 17, 17' are generally parallel to each other. The connector housing 12 is formed from an insulative material by a conventional process, such as injection molding. When viewed in cross-section (FIG. 4), the connector housing sidewalls 17, 17' and floor 19 impart a general U-shaped configuration to the connector housing 12.

Figure 6:
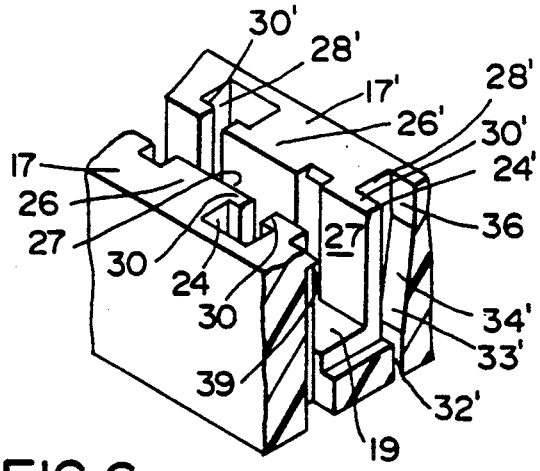
FIG. 6 is a perspective view, in section, showing a portion of the connector housing of the connector of FIG. 1, without the contact terminals in place.

As best seen in FIGS. 5–8, the connector housing 12 includes a plurality of contact-receiving cavities 24 associated with the card slot 18. Each cavity includes an enlarged recess 28 or 28' at one end thereof. The cavities 24 are generally oriented transversely to the channel 18 in side-by side order between the connector opposing end portions 14, 16. (FIG. 5) The cavities 24 are arranged in an alternating fashion such that the enlarged recess 28 or 28' of each cavity is on the opposite side of card slot 18 when compared to the enlarged recesses 28', 28 of its adjacent cavities 24. In this regard, throughout this detailed description, a reference numeral having a prime will refer to an element located on one side of the connector housing longitudinal centerline $C_1$ (FIG. 3) which has a corresponding element located on the opposite side of the centerline. The cavities 24 are separated from each other in a predetermined spacing or pitch by a plurality of partition walls 26, 26' (FIGS. 5, 6). The partitions 26, 26' serve to define interior surfaces 27, 27' of the housing sidewalls 17, 17' which in turn, define card slot 18.

Figure 7:
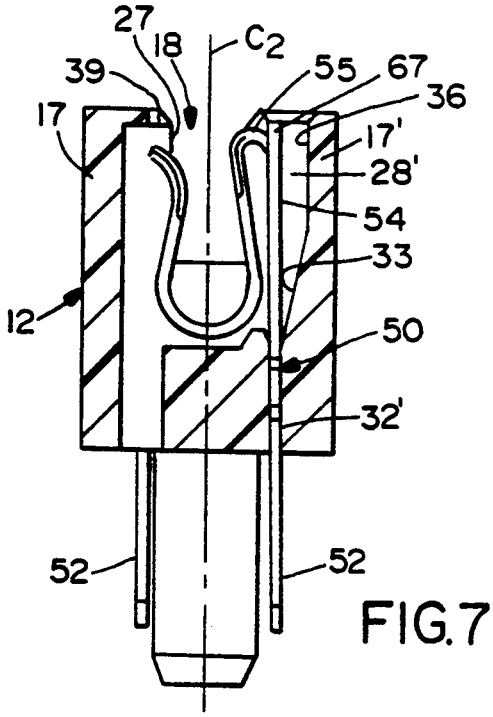
FIG. 7 is a cross-sectional view similar to that of FIG. 4 illustrating a contact terminal in place within a contact-receiving cavity of the connector housing.
Figure 12:
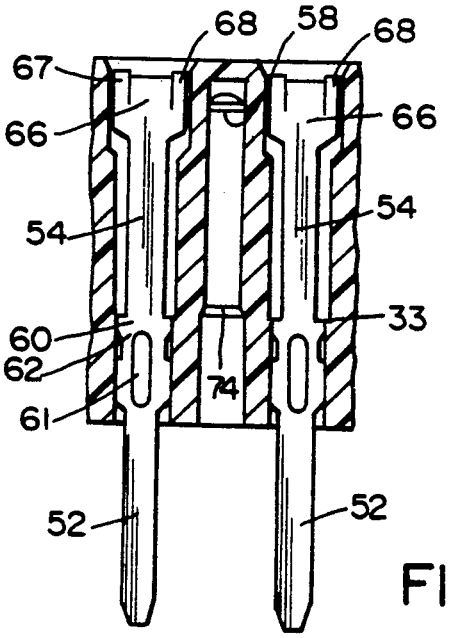
FIG. 12 is a partial sectional side view taken along line 12—12 of FIG. 5 showing the contact terminals in place within the connector housing.

Turning now to FIGS. 6 and 7, each cavity 24 extends within the connector sidewalls 17, 17' and the floor 19 to define a space which receives at least a portion of the contact terminal 50. Each cavity 24 also includes an aperture 32 which extends downwardly through the connector housing 12 and floor 19. The aperture 32 receives a base or solder tail portion 52 of the contact terminal 50. The aperture 32 retains the contact terminal 50 in an interference fit within the cavity 24 as further described below with reference to FIG. 12. Each cavity 24 further has a vertically defined enlarged extension or recess portion 28. Each recess 28 has a width $W_3$ which is greater than the width $W_2$ of the contact cavity 24. Recess 28 may also have a slightly narrower portion 29 (FIG. 12). This width differential defines a pair of stop walls 30, 30' (FIGS. 4, 6) at the interface of each recess 28 and its associated cavity 24 (FIG. 6), the purpose of which is explained in greater detail below.

Turning now specifically to FIG. 4, each recess 28' extends from above the solder tail aperture 32' and extends upwardly through the sidewall 17'. A lower wall 33' of the recess 28' extends upwardly from the aperture 32 at a slight angle and defines an inclined ramp of the recess 28'. The ramped wall 33' extends for a preselected distance and terminates in vertical endwall 36. The lateral extent $D_2$ of the recess, which is the distance between the stop wall 30' and the endwall 36' preferably permits movement therein of a portion 54 of the contact terminal 50. Ramp 33' is inclined to guide the solder tail 52 into aperture 32' during loading of the terminals 50 into the housing 12, such loading occurring from the top of housing 12. In addition, ramp 33' may act as a stop surface during the deflection of the terminal 50. The cavities 24, the recesses 28, 28' and the housing sidewalls 17, 17' may include chamfers which serve to guide the terminal tail portion 52 into the housing apertures 32, 32'.

Figure 10:
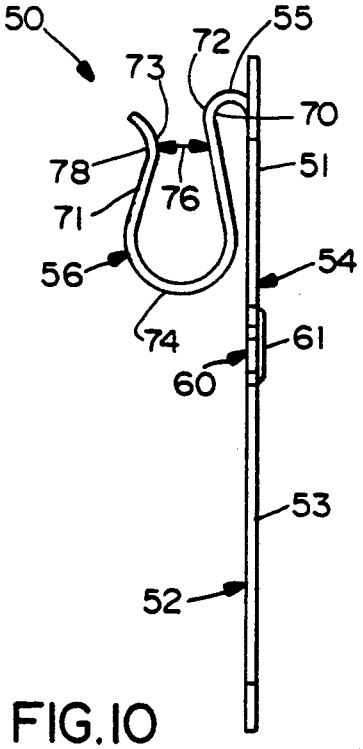
FIG. 10 is an end view of a contact terminal used in the connector of FIG. 1.
Figure 11:
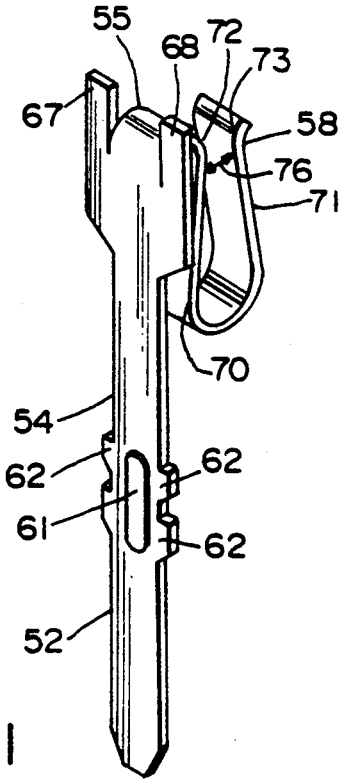
FIG. 11 is a perspective view of the contact terminal of FIG. 10.
Figure 13:
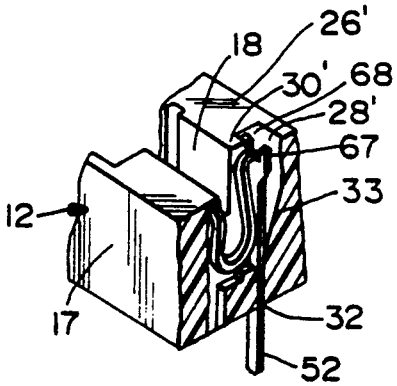
FIG. 13 is a perspective view of a portion of the connector of FIG. 1 showing the contact terminal in place within the connector housing.

As shown in FIGS. 10 and 11, the contact terminal 50 is formed from a single sheet of relatively thin electrically conductive metal, such as beryllium copper or phosphor-bronze. One or more portions of the contact terminal may be plated with an oxidation-resistant material such as gold to improve the conductivity thereof. The terminal solder tail portion 52 extends upwardly and is integrally joined to a generally vertical, cantilevered positioning portion 54 which, in turn, is integrally joined by a generally horizontal transition portion 55 to a contact portion 56. The solder tail portion 52 is adapted to engage the primary circuit board in known manner.

The terminal positioning portion 54 extends upwardly from the solder tail portion 52 at a relatively wide reinforced area 60 which may include one or more outwardly extending barbs 62 which are adapted to engage surfaces 64 of the apertures 32 in an interference fit after insertion of the contact element 50 into the cavity 24. (FIG. 12) The reinforced area 60 preferably includes an embossment 61 disposed therewithin. The embossment 61 serves to increase the section modulus of this area of the terminal 50, thereby increasing the stiffness of this area to increase the resistance thereof to stresses imparted during insertion of the terminal 50 into the cavity 24.

The terminal positioning portion 54 extends generally vertically within the recess 28 when inserted into the contact cavity 24. Because of the lateral extent $D_2$ of recess 28, the positioning portion 54 is able to deflect within the recess 28 when a circuit card 100 is inserted into the card slot 18. (FIGS. 8, 9) The positioning portion 54 has an increased width where the positioning portion 54 and transition portion 55 are joined together which defines two projections 67, 68 from the positioning portion 54. These projections 67, 68 engage the recess shoulder walls 30 to limit the movement of the contact terminal 50 into the card slot 18 during insertion of the circuit card 100 into the card slot 18. The interaction between projections 67, 68 and stop walls 30 limits the extent to which the first, or upper, contact surface 72 protrudes into the channel 18 to substantially reduce the possibility of stubbing the same with the bottom edge 106 of circuit card 100. If desired, projections 67, 68 could be used to preload the terminal 50 up against shoulder walls 30.

The transition portion 55 of the contact terminal 50 extends generally horizontally outwardly from the positioning portion 54 in a cantilevered manner. The transition portion 55 connects the contact portion 56 to positioning portion 54. The contact portion 56 is formed, after stamping, into a general U-shape in which the U-portion thereof has two opposing contact arms 70, 71 disposed on opposite sides thereof with bight 74 therebetween. The contact arms 70, 71 include contact surfaces 72, 73 on their protruding surfaces which are formed by coining.

Coining changes the cross-sectional profile of the contact surfaces from a flat planar surface to a relatively curved surface having a raised central portion. The raised, central portion provides a contact surface having a reduced area as compared to a flat surface. A curved contact surface requires less contact force in order for the contact terminal 50 to exert a desired, predetermined pressure against the contact pads 104 of the card 100. The opening 76 should be dimensioned smaller than the width of an edge card 100 that is to be inserted into the connector to ensure deflection of both arms 70, 71 and thus good contact between contact surfaces 72, 73 and contact pads 104 of the edge card.

The first contact arm 70 extends from the transition portion 55 and curves downwardly and away from the vertical centerline $C_2$ (FIG. 8) of the card slot 18 along a preselected radius until it reaches a bight 74 which interconnects the first contact arm 70 with the second contact arm 71. The second contact arm 71 extends upwardly from the bight 74 and inwardly toward centerline $C_2$ until reaching end 58 which then curves outwardly from centerline $C_2$. The two contact arms 70, 71 define an edge card receiving opening 76 between them. (FIG. 10) This opening 76 increases in width from the contact surfaces 72, 73 down to the bight 74 and assists in imparting the preferred spring characteristics to the contact portion 56 which ensures a reliable electrical connection between the terminal 50 and the edge contact pads 104 of the circuit card 100.

Contact surfaces 72, 73 are at different heights relative to the top of the housing 12 prior to insertion of an edge card to stagger the deflection forces and thus reduce the peak insertion force. As best seen in FIG. 7, a portion of the free end 58 of the terminal 50 extends beneath the ledge portion 39 when the contact terminal 50 is in an unmated, or undeflected, position. This prevents the bottom edge 106 of the card 100 from stubbing the free end 58 of the second contact arm 72 which could damage the terminal 50.

When assembled, the solder tail portion 52 is anchored in the contact cavity aperture 32 by its engagement barbs 62 (FIGS. 11, 12). The positioning portion 54 extends vertically within the contact cavity recess 28 (FIG. 7), while contact surfaces 72, 73 extend into the card slot 18. The distance that the first contact arm 70 extends into the card slot 18 is limited by the engagement of the contact element positioning shoulders 67, 68 with the connector housing recess shoulder walls 30.

Figure 8:
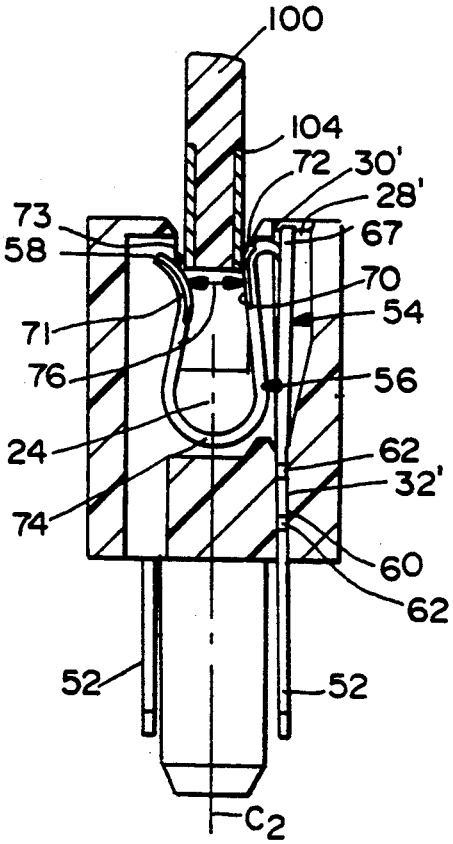
FIG. 8 is the same view as FIG. 7 showing an edge card initially inserted into the card slot.
Figure 9:
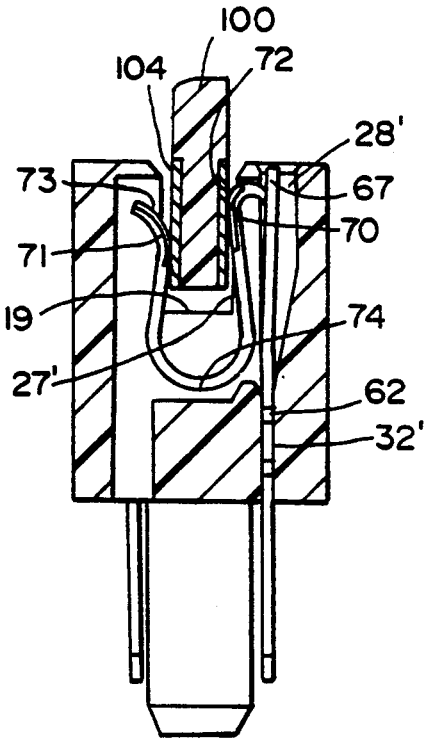
FIG. 9 is the same view as FIG. 8 showing the edge card further inserted into the connector housing slot.

FIGS. 7–9 illustrate best the manner of deflection of the contact terminal 50 from an undeflected position prior to insertion of the card 100 into the card slot 18 (FIG. 7) to an initial deflected position where the card is partially inserted into the card slot 18 (FIG. 8) to a completely deflected position where the card 100 is fully inserted into the card slot 18. (FIG. 9) When an edge card 100 is inserted into the card slot 18 as shown in FIG. 8, the marginal edge 106 having the contact pads 104 slidingly engages the curved contact surface 72 of the first contact arm 70. The contact terminal positioning portion 54 is free to move within the connector housing recess 28' and deflects away from the card slot centerline $C_2$ within the recess 28', such that it partially pivots relative to the tail portion 52 about the reinforced area 60. This deflection urges U-shaped contact portion 56 to the right as viewed in FIG. 8 to force the second contact arm 71 further into the card slot 18. Further insertion of the edge card 100 into the connector body channel 18 causes the contact arms 71 to deflect outwardly away from centerline $C_2$ and appropriately contact the edge card 100 at the contact pad portions 104 thereof. By virtue of the spring characteristics of the contact arms 70, 71, the coined contact surfaces 72, 73 react to apply a desired normal force to the edge card 100. Terminal positioning portion 54 also exerts a lateral force on the circuit card 100, which combines with the normal forces of the terminal contact arms 70, 71 to bias the card toward the center of card slot 18. Because of the alternating orientation of the cavities 24 and thus the contact terminals 50 therein, and the biasing nature of the terminals, the connector 10 may accommodate circuit cards which are warped or bowed approximately 0.29 mm from the centerline $C_2$. Accordingly, a circuit card having warpage within the above described tolerance will tend to flatten out when properly mated with the connector 10.

Because the contact terminal 50 is stamped and formed and because of its configuration within housing 12, the overall width of the housing may be as small as 5.0 mm. This reduced spacing advantageously permits the connector 10 to be used with SIMMs, or other modules, having relatively thin chips thereon, thereby freeing up space for other circuit components on the primary circuit board. Connectors constructed in accordance with the present invention thus permit a reduction in spacing of adjacent connectors on the mother board of from over 7.0 mm to approximately 5.08 mm.

Since the contact arms 70, 71 are formed from the said single piece of sheet metal and contact pads 104 of the edge card that are laterally aligned are electrically connected, a redundant contact system is achieved when an edge card is mated with the connector 10.

Returning to FIG. 1, the connector 10 may also include a latch/eject mechanism 200 pivotally mounted at an end 16 of the connector housing 12. The latch/eject mechanism 200 includes a latch member 202 stamped and formed, as shown, from a metal blank. The latch member 202 is held between two vertical extensions 206, 207 of the connector body 12 by a pivot pin 208 which extends through the connector body extensions 206, 207. A post 210 for centering and supporting the mechanism 200 may be located between the extensions 206, 207. Latch member 202 can be rotated between ejected and latched positions through the application of force to the top or bottom of manually manipulatable portion 254.

The latch member 202 includes two engagement arms 216, 218 extending upwardly in a cantilevered manner from respective base members 220, 221 in a spaced-apart relationship. Each engagement arm 216, 218 is provided with inwardly projecting, generally triangularly shaped bosses 219 which engage similarly positioned opening 112 on the edge card 100. When viewed in end profile, the engagement arms 216, 218 extend slightly inwardly toward each other and then outwardly to define lead-in portions 222, 223 which permit, because of their slope, an edge card 100 to be inserted into the mechanism 200 when the latch/eject mechanism is in either a latched or ejected orientation.

A hole 256 is adjacent the lower edge of boss 219. A pair of outwardly projecting bumps 258 are also provided on leg 204 that interact with recesses 260 contained in housing extensions 206, 207 to retain the latch member in a lateral position. Finally, ejection ledge 262 is positioned between base members 220, 221 to engage the lower surface 106 of edge card 100 when ejecting the card.

When an edge card is positioned in connector 10 and the latch member is in its latched position, bosses 219 extend into hole 112 in the card. Hole 256 creates a generally abrupt edge at the lower portion of boss 219. As a result, the edge interferes with the lower edge of hole 112 if the card is attempted to be removed while the latch member 202 is in its latched position. Upon rotating latch member 202 towards its ejected position, the corner 264 of boss 219 closest to the manipulatable portion 254 begins to contact side edge 266 of hole 112 which causes arms 216, 218 to spread apart thus providing clearance to permit hole 112 to pass by the lower abrupt edge of boss 219 and eject card 100.

At the opposite end 14 of housing 12, two additional extensions 240, 241 extend upwardly in a spaced-apart relationship to define an edge card entry slot 242 therebetween. The extensions 240, 241 preferably each include a downwardly sloped ramp 244 which directs the edge card 100 into proper orientation for insertion into the connector channel 18. Extensions 240, 241 may further include bosses 246 extending therefrom into the entry slot 242 between them that project into openings 110 when the card 100 is inserted into housing 12.

It will be seen that while certain embodiments of the present invention have been shown and described, it will be obvious to those skilled in the art that changes and modifications may be made therein without departing from the true spirit and scope of the inventions.

We claim:

1. A push/pull edge card connector for providing an electrical connection between a first plurality of contacts on a primary circuit member and a second plurality of contacts on a printed circuit card, the circuit card having a plurality of contacts disposed on an edge thereof, the circuit card edge being insertable into and removable from the connector, said circuit card being generally planar in nature and having first and second circuit faces, each of the first and second circuit faces having a row of circuit card contacts generally parallel to and adjacent an edge of said circuit card, one card contact of each row being laterally aligned with and electrically connected to a card contact of the other row to establish a pair of aligned contact pads, and wherein said connector includes means for mounting said connector to the primary circuit member, said connector comprising:

a generally elongated connector housing formed from an electrically insulative material, the connector housing having a lower face adapted for positioning adjacent said primary circuit member and an upper face spaced-apart therefrom having an elongated card slot disposed therein and extending between two opposing end portions of said connector, the card slot being adapted to receive said circuit card edge therein in an electrically operative manner, the connector housing further including a plurality of contact-receiving cavities spaced apart along said card slot and at least partially in communication therewith, said card slot having a predetermined longitudinal centerline;

a stamped and formed resilient contact terminal disposed in each of said contact-receiving cavities, each contact terminal including a tail for electrically and mechanically interconnecting said contact terminal to one of said first plurality of contacts on said primary circuit member, a positioning portion integrally joined to the tail portion at one end of said positioning portion and a generally U-shaped circuit card-receiving portion integrally joined to the positioning portion at a second end of said positioning portion, the positioning portion including a cantilevered member extending within said contact cavity and being deflectable within said contact cavity, the card-receiving portion including first and second spring arms, contact portions of the first and second spring arms protruding into said card slot for slidingly engaging said contact pads upon insertion of said circuit card into said elongated slot, each said contact terminal having a width in a direction parallel to the longitudinal centerline of said card slot substantially greater than the thickness of the material from which it is formed; and said housing being configured and said contact terminals being positioned in said contact-receiving cavities such that said tail portions of adjacent contact elements are positioned on opposite sides of said longitudinal centerline of said elongated slot to define a staggered pattern.

2. The connector of claim 1, wherein each of said contact terminal first and second spring arms are coined to provide raised first and second contact surfaces.

3. The connector of claim 1, wherein each of said contact-receiving cavities includes a recess portion, the recess portion including at least one stop surface which engages said contact terminal positioning portion upon insertion of said circuit card into said card slot, thereby limiting movement of said contact terminal first spring arm in said card slot.

4. The connector of claim 1, wherein said positioning portion is a vertically cantilevered member and said card-receiving portion includes a horizontal cantilevered member.

5. The connector of claim 1, wherein said contact-receiving cavity includes a ledge portion overhanging a free end of said contact terminal to reduce the possibility of stubbing said second spring arm upon insertion of said circuit card into said card slot.

6. The connector of claim 1, wherein the contact portion of said first spring arm is disposed closer to said housing upper face than the contact portion of said second spring arm, whereby the contact portion of said first spring arm is first engaged by said circuit card and the contact portion of said second spring arm is next engaged by said circuit card upon insertion of said circuit card into said card slot.

7. The connector of claim 1, wherein said terminal tail and positioning portions are integrally joined together at a retention portion, the retention portion including means for retaining said contact terminal in place within said housing, said retaining means including at least one member interferingly engaging said contact-receiving cavity, said contact retention means further including embossment means for resisting stress imparted to said contact terminal during insertion of said contact terminal into said contact-receiving cavity.

8. The connector of claim 1 wherein the contact portion of one said first and second spring arms is disposed closer to said housing upper face than the contact portion of the other of said first and second spring arms, whereby the contact portion disposed closer to said housing upper face is first engaged by said circuit card and the other contact portion is next engaged by said circuit card upon insertion of said circuit card into said card slot.

9. The connector of claim 1, wherein each of said contact-receiving cavities includes a stop member, the stop member engaging a part of said contact terminal positioning portion and limiting movement of said contact terminal first spring arm into said card slot.

10. The connector of claim 9, wherein the contact portion of said first spring arm is disposed closer to said housing upper face than the contact portion of said second spring arm, whereby the contact portion of said first spring arm is first engaged by said circuit card and the contact portion of said second spring arm is next engaged by said circuit card upon insertion of said circuit card into said card slot.

11. The connector of claim 1, wherein each said contact terminal is positioned along a plane generally perpendicular to the longitudinal centerline of said card slot, said contact terminal includes at least one shoulder portion projecting out of said plane and each said contact-receiving cavity includes a recess within said connector housing, the recess being a stop surface which engages said terminal shoulder to limit movement of said contact terminal positioning portion therein upon insertion of said circuit card into said card slot.

12. The connector of claim 11, wherein said recess stop surface includes two generally vertical endwalls disposed generally parallel to said card slot and generally transverse to said contact-receiving cavity.

13. The connector of claim 11, wherein the dimension of said recess in a direction parallel to said longitudinal centerline is greater than the dimension of a portion of said contact-receiving cavity positioned between said recess and said elongated slot in a direction parallel to said longitudinal centerline.

14. The connector of claim 11, wherein said housing further includes a pair of generally parallel sidewalls defining a portion of said elongated slot, each said contact-receiving cavity having a first dimension in a direction parallel to said longitudinal centerline immediately adjacent said elongated slot, each said recess having a second dimension in a direction parallel to said longitudinal centerline, said second dimension being greater than said first dimension, and said housing being configured such that the recess of any contact-receiving cavity is located in one of said sidewalls and the recess of each contact-receiving cavity immediately adjacent said any contact-receiving cavity is located in said other sidewall.

15. In an electrical connector for providing an electrical connection between a plurality of card contacts on a circuit card generally adjacent an edge thereof and a plurality of board contacts on a circuit board, said circuit card being generally planar and having first and second faces, said first and second faces each having a row of card contacts generally parallel to and adjacent said edge, one card contact of each row being laterally aligned with and electrically connected to a card contact of the other row to establish a pair of aligned contact pads, said connector including an insulative housing having a lower face for positioning adjacent said circuit board, an upper face having an elongated card slot therein for receiving said edge of said circuit card, and a plurality of contact-receiving cavities spaced along the card slot and in communication therewith, said card slot having a longitudinal centerline, a stamped and formed resiliently deflectable contact terminal positioned in each of said contact-receiving cavities, each contact terminal having a tail portion for electrically and mechanically interconnecting said contact terminal to one of the board contacts of said circuit board, and a generally U-shaped circuit card receiving portion for contacting both contact pads of one of said pairs of contact pads, said generally U-shaped card-receiving portion having first and second resilient arms with contact portions thereon for slidingly engaging said contact pads when said circuit card is inserted into said card slot, each said contact terminal having a width in a direction parallel to the longitudinal centerline of said card slot substantially greater than the thickness of the material from which it is formed, wherein the improvement comprises:

said tail portion being offset from the longitudinal centerline of said elongated slot; and said contact terminals being positioned in said contact-receiving cavities such that said tail portions of adjacent contact elements are positioned on opposite sides of said longitudinal centerline of said elongated slot.

16. The connector of claim 15, wherein the contact portion of said first resilient arm is disposed closer to said housing upper face than the contact portion of said second resilient arm, whereby the contact portion of said first resilient arm is first engaged by said circuit card and the contact portion of said second resilient arm is next engaged by said circuit card upon insertion of said circuit card into said card slot.

17. The connector of claim 13, wherein said tail portion is offset from said circuit card receiving portion and adjacent contact terminals are oppositely oriented such that said tail portions of adjacent contact elements are positioned on opposite sides of the longitudinal centerline of said card slot to define a staggered pattern.

18. The connector of claim 15 wherein the contact portion of one of said first and second spring arms is disposed closer to said housing upper face than the contact portion of the other of said first and second spring arms, whereby the contact portion disposed closer to said housing upper face is first engaged by said circuit card and the other contact portion is next engaged by said circuit card upon insertion of said circuit card into said card slot.

19. The connector of claim 15, wherein a terminal positioning portion interconnects said tail portion to said circuit card-receiving portion, the positioning portion extending from said tail portion in a cantilevered manner and said circuit card receiving portion extending from said positioning portion in a cantilevered manner, the positioning portion further being received by a recess associated with said contact-receiving cavity, said positioning portion being movable within said recess upon insertion of said circuit card into said card slot.

20. The connector of claim 19, wherein each of said contact-receiving cavities includes a stop member, the stop member engaging a part of said terminal positioning portion and limiting movement of said contact terminal first resilient arm into said card slot.

21. The connector of claim 19, further including a vertical recess at least partially communicating with said contact receiving cavity, the terminal positioning portion being disposed in the recess and deflecting therein upon insertion of said circuit card into said card slot.

22. The connector of claim 19, wherein said contact terminal includes at least one shoulder portion and each said contact-receiving cavity includes a recess within said connector housing, the recess having a stop surface which engages said terminal shoulder to limit movement of said terminal positioning portion therein upon insertion of said circuit card into said card slot.

23. The connector of claim 22, wherein the dimension of said recess in a direction parallel to said longitudinal centerline is greater than the dimension of a portion of said contact-receiving cavity positioned between said recess and said elongated slot in a direction parallel to aid longitudinal centerline.

24. An edge card connector for receiving the edge of a circuit card comprising:

an elongated housing having a circuit card receiving face with an elongated circuit card slot longitudinally extending therein between two opposing ends of the housing, the housing having a plurality of equally spaced contact terminal-receiving cavities separated by partition walls, each of said cavities having a distinct recess associated therewith, each cavity having an aperture extending therethrough;

a plurality of stamped and formed resilient contact terminals being disposed in respective cavities, each said contact terminal having a width in a direction parallel to the longitudinal centerline of said card slot substantially greater than the thickness of the material from which it is formed and including a tail portion extending through said cavity aperture, a positioning portion extending upwardly from the terminal tail portion through said cavity recess and a circuit card-receiving portion extending from an end of said positioning portion opposite said tail portion and projecting into said card slot, each card-receiving portion including a pair of opposing contact arms extending upwardly from an interconnecting bight portion, said two contact arms and said bight portion defining said U-shaped circuit card-receiving portion of said terminal, a first of said two contact arms being integrally joined to said positioning portion, the second of said two contact arms having a free end, the terminal positioning portion being deflectable in said cavity recess between distinct first and second operative positions, said terminal further including at least one shoulder portion adjacent a junction of said positioning portion and said circuit card-receiving portion, each shoulder being positioned adjacent a respective stop surface of said cavity recess when said terminal is in said first operative position, thereby preventing said positioning portion from deflecting into said card slot, said positioning portion being deflected into the second operative position upon insertion of a circuit card into said card slot whereby said positioning portion is deflected into said cavity recess and the second contact arm is deflected towards the centerline of said card slot.

25. The connector of claim 24, wherein said tail portion is offset from said circuit card receiving portion and adjacent contact terminals are oppositely oriented such that said tail portions of adjacent contact elements are positioned on opposite sides of the longitudinal centerline of said card slot to define a staggered pattern.

26. The connector of claim 24, wherein said free end of said circuit card-receiving portion is maintained under a ledge of said housing.

* * * * *